US007641301B2

(12) United States Patent
Hayamizu et al.

(10) Patent No.: US 7,641,301 B2
(45) Date of Patent: Jan. 5, 2010

(54) IMAGE RECORDING APPARTUS AND IMAGE RECORDING METHOD

(75) Inventors: Kazuhiro Hayamizu, Nagoya (JP); Yoshinari Morimoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 447 days.

(21) Appl. No.: 11/277,621

(22) Filed: Mar. 28, 2006

(65) Prior Publication Data

US 2006/0232621 A1 Oct. 19, 2006

(30) Foreign Application Priority Data

Mar. 29, 2005 (JP) ..... 2005-093892

(51) Int. Cl.
*B41J 29/393* (2006.01)

(52) U.S. Cl. ..... 347/19; 347/104; 347/105

(58) Field of Classification Search ..... None
See application file for complete search history.

(56) References Cited

U.S. PATENT DOCUMENTS

| | | | | |
|---|---|---|---|---|
| 6,945,721 | B2 | 9/2005 | Sato | |
| 2002/0033851 | A1 | 3/2002 | Waldner et al. | |
| 2004/0141782 | A1 | 7/2004 | Kato | |
| 2004/0223022 | A1 | 11/2004 | Endo | |
| 2004/0246290 | A1 * | 12/2004 | Hayashi et al. | 347/19 |
| 2006/0050099 | A1 * | 3/2006 | Murakami et al. | 347/19 |

FOREIGN PATENT DOCUMENTS

| | | | |
|---|---|---|---|
| EP | 1449670 | A1 | 8/2004 |
| EP | 1541351 | A1 | 6/2005 |
| JP | H11-048556 | A | 2/1999 |
| JP | 2004090316 | A | 3/2004 |
| JP | 2004182361 | A | 7/2004 |
| JP | 2004-291313 | A | 10/2004 |

OTHER PUBLICATIONS

Japan Patent Office; Notice of Reasons for Rejection in Japanese Patent Application No. 2005-093892 (counterpart to the above-captioned U.S. patent application) mailed Mar. 17, 2009.

* cited by examiner

*Primary Examiner*—Matthew Luu
*Assistant Examiner*—Justin Seo
(74) *Attorney, Agent, or Firm*—Baker Botts L.L.P.

(57) ABSTRACT

An image recording apparatus includes a conveying mechanism for conveying a recording medium in a conveying direction, and a scanning carriage including a recording head for and a detector. The detector detects a first edge and a second edge of the recording medium in a leading edge detection region and in an intermediate detection region located between the leading edge detection region and the trailing edge of the recording medium. The scanning carriage moves in a scanning direction orthogonal to the conveying direction. Moreover, the image recording apparatus includes a storing unit for storing a first position of the first edge and a second position of the second edge, which are detected by the detector. The image recording apparatus further includes a controller for controlling movement of the scanning carriage. The controller controls a moving speed of the scanning carriage, such that the detector detects across the recording medium in the scanning direction including the first edge and the second edge. The detector detects the first and the second edge according to the first position of the first and the second position of the second edge in a leading edge detection region.

9 Claims, 13 Drawing Sheets

IMAGE RECORDING APPARTUS AND IMAGE RECORDING METHOD

CROSS REFERENCE TO RELATED APPLICATION

The present application claims priority from Japanese Patent Application No. 2005-093892, filed on Mar. 29, 2005, the disclosure of which is incorporated herein by reference in its entirely.

BACKGROUND OF THE INVENTION

1. Field of the Invention

The present invention is related generally to an image recording apparatus that records an image on a recording medium, and more particularly, to an ink-jet recording apparatus that performs image recording by ejecting ink drops on to a recording medium.

2. Description of Related Art

In an image recording apparatus using ink (generally referred to as an ink-jet recording apparatus), inks of different hues, such as yellow, cyan, magenta, and black, are supplied to the recording head, and a color image is formed by ejecting ink of the respective colors from the recording head according to a specific method for forming dots on a recording medium. A recent recording apparatus is able to perform image recording using a technique, called "marginless recording." Marginless recording is a recording method by which image recording similar to a picture may be achieved by ejecting ink across the entire recording medium (that is, ink is ejected to the outer border of the recording medium).

In a case where the marginless recording is performed, there is a need to convey a recording medium precisely so that no margin is formed in the outer border portion. In other words, there is a need to detect the exact position of the edge of the recording medium being conveyed. Various image recording methods have been proposed in the related art. For example, in one known image recording method, a media sensor is mounted to the carriage that holds the recording head, and the media sensor detects the positions of both edges of a recording medium each time an image is recorded on to the recording medium by a specific feed amount (for example, ¼ inch), so that scanning of the carriage is controlled according to the detection result.

In this known image recording method, the media sensor comprises, for example, a light transmitting element and a light receiving element. Light transmitted from the light transmitting element is reflected on a recording medium and the presence of a recording medium is detected as the light receiving element receives the reflected light. For the position of the edge of the recording medium to be detected exactly by such a media sensor, the media sensor moves at a low speed with respect to the recording medium. This known image recording method, however, takes a long time to detect the position of edge of the recording medium, which increases an amount of time needed for image recoding.

SUMMARY OF THE INVENTION

Therefore a need has been arisen for achieving high-speed and satisfactory image recording (in particular, satisfactory marginless recording in the case of an ink-jet recording apparatus) by quickly sensing the position of the edge of the recording medium being conveyed.

According to one embodiment of the present invention, an image recording apparatus comprises a conveying mechanism for conveying a recording medium in a conveying direction, and a scanning carriage comprising a recording head and a detector. The recording head records an image on the recording medium. The detector comprises a signal source for transmitting a detection signal to a surface of the recording medium and a signal receiving device for receiving a reflected signal from the recording medium to detect a first edge and a second edge of the recording medium in a leading edge detection region and in an intermediate detection region located between the leading edge detection region and the trailing edge of the recording medium. The scanning carriage moves in a scanning direction orthogonal to the conveying direction.

Moreover, the image recording apparatus comprises a storing unit for storing a first position of the first edge of the recording medium in the scanning direction and a second position of the second edge of the recording medium in the scanning direction, which are detected by the detector. The image recording apparatus further comprises a controller for controlling movement of the scanning carriage. The controller controls a moving speed of the scanning carriage, such that the detector detects across the recording medium in the scanning direction including the first edge in the scanning direction and the second edge in the scanning direction in the leading edge detection region and in the intermediate detection region. The detector detects the first edge in the scanning direction and the second edge in the scanning direction in sheet edge region adjacent to the first edge and the second edge, respectively, according to the first position of the first edge in the scanning direction and the second position of the second edge in the scanning direction in the leading edge detection region.

According to another embodiment of the present invention, an image recording method using an image recording device, where the device comprises a conveying mechanism, a scanning carriage comprising a recording head and a detector, a storing unit for storing an edge, and a controller for controlling movement of the scanning carriage, comprises the steps of (a) conveying a recording medium in a conveying direction, and (b) moving the scanning carriage in a scanning direction orthogonal to the conveying direction. The image recording method also comprises the steps of (c) controlling the moving speed of the scanning carriage, and (d) detecting a first edge of the recording medium in the scanning direction and a second edge of the recording medium in the scanning direction in a leading edge detection region and in an intermediate detection region located between the leading edge detection region and the trailing edge of the recording medium. Moreover, the image recording method also comprises the steps of (e) storing a first position of the first edge of the recording medium in the scanning direction and a second position of the second edge of the recording medium in the scanning direction, and (f) recording an image on the recording medium. The step (d) is performed in the intermediate detection region such that the first edge of the recording medium in the scanning direction and the second edge of the recording medium in the scanning direction are detected in sheet edge region adjacent to the first edge and the second edge, respectively, according to the first position of the first edge in the scanning direction and the second position of the second edge in the scanning direction in the leading edge detection region.

According to yet another embodiment of the present invention, an image recording apparatus comprises a conveying means for conveying a recording medium in a conveying direction, and a scanning carriage comprising a recording head for and a detector. The recording head records an image on the recording medium. The detector comprises a signal source for transmitting a detection signal to a surface of the recording medium and a signal receiving device for receiving a reflected signal from the recording medium to detect a first edge and a second edge of the recording medium in a leading edge detection region and in an intermediate detection region located between the leading edge detection region and the trailing edge of the recording medium. The scanning carriage moves in a scanning direction orthogonal to the conveying direction. Moreover, the image recording apparatus comprises a storing means for storing a first position of the first edge of the recording medium in the scanning direction and a second position of the second edge of the recording medium in the scanning direction, which are detected by the detector. The image recording apparatus further comprises a controlling means for controlling movement of the scanning carriage. The controller controls a moving speed of the scanning carriage, such that the detector detects across the recording medium in the scanning direction including the first edge in the scanning direction and the second edge in the scanning direction in the leading edge detection region and in the intermediate detection region. The detector detects the first edge in the scanning direction and the second edge in the scanning direction in sheet edge region adjacent to the first edge and the second edge, respectively, according to the first position of the first edge in the scanning direction and the second position of the second edge in the scanning direction in the leading edge detection region.

Other features and advantages of the present invention will be apparent to persons of ordinary skill in the art in view of the following detailed description of the invention and the following drawings.

BRIEF DESCRIPTION OF THE DRAWINGS

For a more complete understanding of the present invention, the needs satisfied thereby, and the features and advantages thereof, reference now is made to the following descriptions taken in connection with the accompanying drawings.

DETAILED DESCRIPTION OF EMBODIMENTS

Embodiments of the invention and their features and advantages may be understood by referring to FIGS. 1-13, like numerals being used for like corresponding parts in the various drawings.

Figure 1:
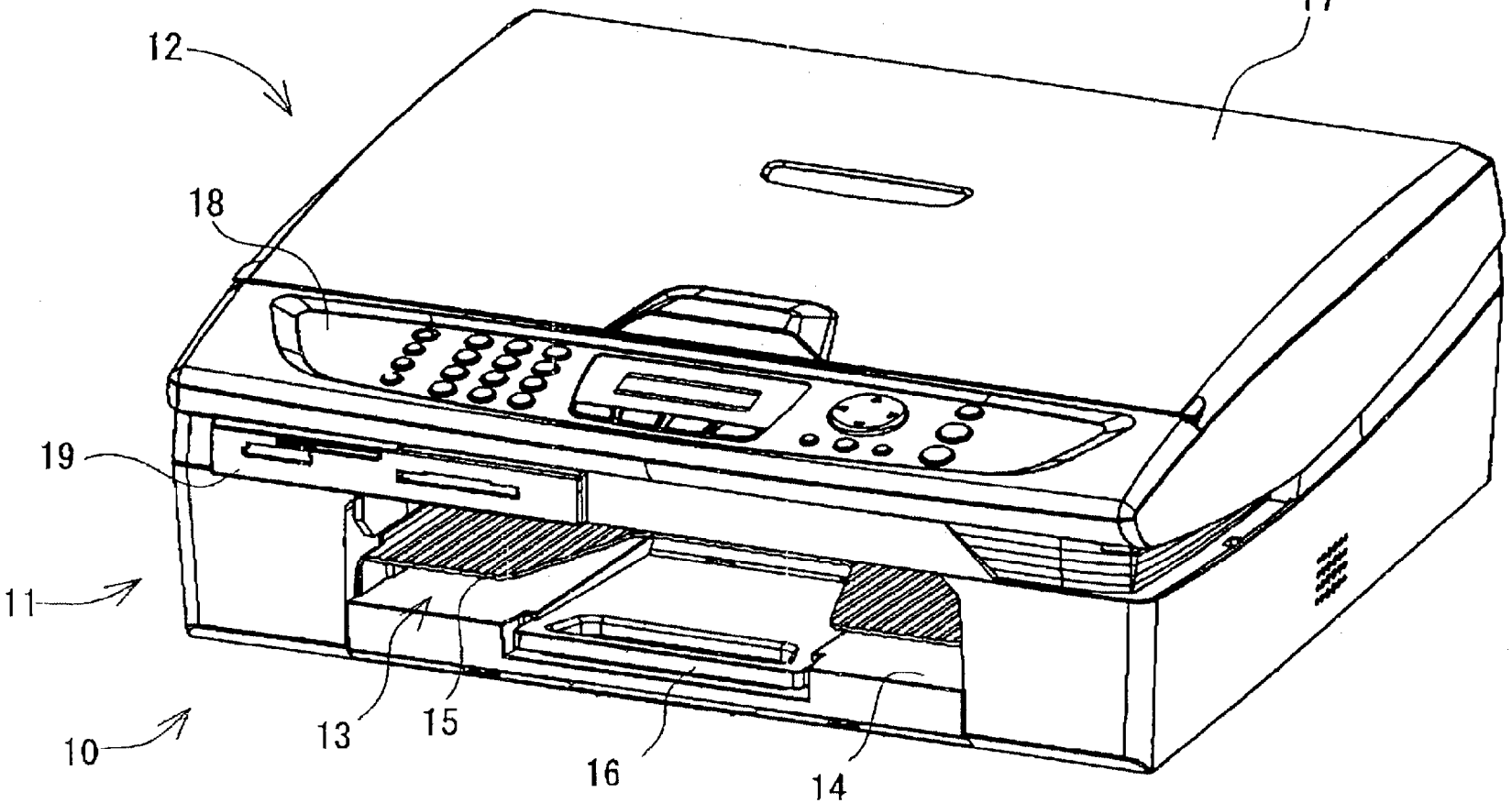
FIG. 1 is a perspective view of a multi-functional peripheral according to a first embodiment of the present invention.

FIG. 1 is a perspective view of a multi-functional peripheral 10 (image recording apparatus) according to a first embodiment of the invention. The multi-functional peripheral 10 may be a multi-function device (MFD), in which a printer portion 11 at the lower portion and a scanner portion 12 at the upper portion are integrally provided, and may be furnished with a printer function, a scanner function, or a copying function, or a combination thereof. In the multi-functional peripheral 10, the printer portion 11 may correspond to the image recording apparatus (in particular, an ink-jet recording apparatus in this embodiment) of the present invention. In this embodiment, functions other than the printing function are omitted. The present invention thus may be applied to a single-function printer having neither the scanner function nor the copying function by omitting the scanner portion 12. The present invention also may be applied to an apparatus comprising a communication portion, and may be furnished with a facsimile function, or the like.

When the present invention is implemented as an ink-jet recording apparatus comprising a multi-functional peripheral, it may be formed as a small-sized apparatus as the multi-functional peripheral 10 according to the first embodiment, or it may be formed as a large-scaled apparatus provided with more than one sheet feeding cassette and an auto document feeder (ADF). Moreover, the present invention may be applied not only to an ink-jet recording apparatus, but also to a general image recording apparatus provided with the recording head that performs an image recording operation on to a recording medium (generally, a recording sheet). Also, the multi-functional peripheral 10 may be connected to an unillustrated computer, so that it records an image or a document on a recording medium according to image data or document data transmitted from the computer. Further, the multi-functional peripheral 10 may be connected to a digital camera to record image data outputted from the digital camera on to a recording medium, or various recording media may be inserted for image data or the like recorded in the recoding media to be recorded on to a recording medium.

As is shown in FIG. 1, the multi-functional peripheral 10 may comprise an outside shape forming a wide and thin rectangular prism, and the multi-functional peripheral 10 may be designed so that the width and the depth are larger than the height. The printer portion 11 may be provided at the lower portion of the multi-functional peripheral 10. The printer portion 11 may have an opening 13 formed in the front surface. A sheet feeding tray 14 and a sheet discharging tray 15 may be provided in two stages at the top and bottom to be exposed through the opening 13. The sheet feeding tray 14 stores recording medium, and accommodates recording medium of various sizes up to the A4 size, including the B5 size, a postcard size, and the like. The sheet feeding tray 14 may be provided with a slide tray 16. The tray surface may be enlarged by pulling out the slide tray 16 as the need arises. Recording medium accommodated in the sheet feeding tray 14 may be fed to the interior of the printer portion 11, and each recording medium may be discharged on to the sheet discharging tray 15 after a specific image is recorded thereon.

The scanner portion 12 may be provided at the upper portion of the multi-functional peripheral 10. The scanner portion 12 may be a so-called flat bed scanner. The multi-functional peripheral 10 may comprise a document cover 17. The document cover 17 may be provided to be free to open and close with respect to the multi-functional peripheral 10, and may serve as the top plate of the multi-functional peripheral 10. Unillustrated platen glass and image reading carriage may be provided under the document cover 17. The platen glass may be used to place a document thereon. The image reading carriage may be provided under the platen glass, and may be configured to slide in the scanning direction (the width direction of the multi-functional peripheral 10). The image reading carriage scans a document as it slides in the width direction of the multi-functional peripheral 10.

A manipulation panel 18 may be provided at the upper portion of the front surface of the multi-functional peripheral 10. The manipulation panel 18 may be a device used to manipulate the printer portion 11 and the scanner portion 12. The manipulation portion 18 may comprise various manipulation buttons and the liquid crystal display portion. The multi-function peripheral 10 operates according to a manipulation instruction on the manipulation panel 18 or an instruction transmitted from the computer via a printer driver. The manipulation panel 18 and the printer driver may function as input means for inputting the size (postcard size, A4 sizes or the like) of a recording medium. Also, a slot portion 19 may be provided at the upper left portion of the front surface of the multi-functional peripheral 10. Various small-sized memory cards comprising memory media may be inserted into the slot portion 19. Image data recorded in the small-sized memory card may be displayed on the liquid crystal display portion. An arbitrary image recorded in the small-sized memory card may be recorded on a recording medium by the printer portion 11 as the manipulation panel 18 is manipulated.

Figure 2:
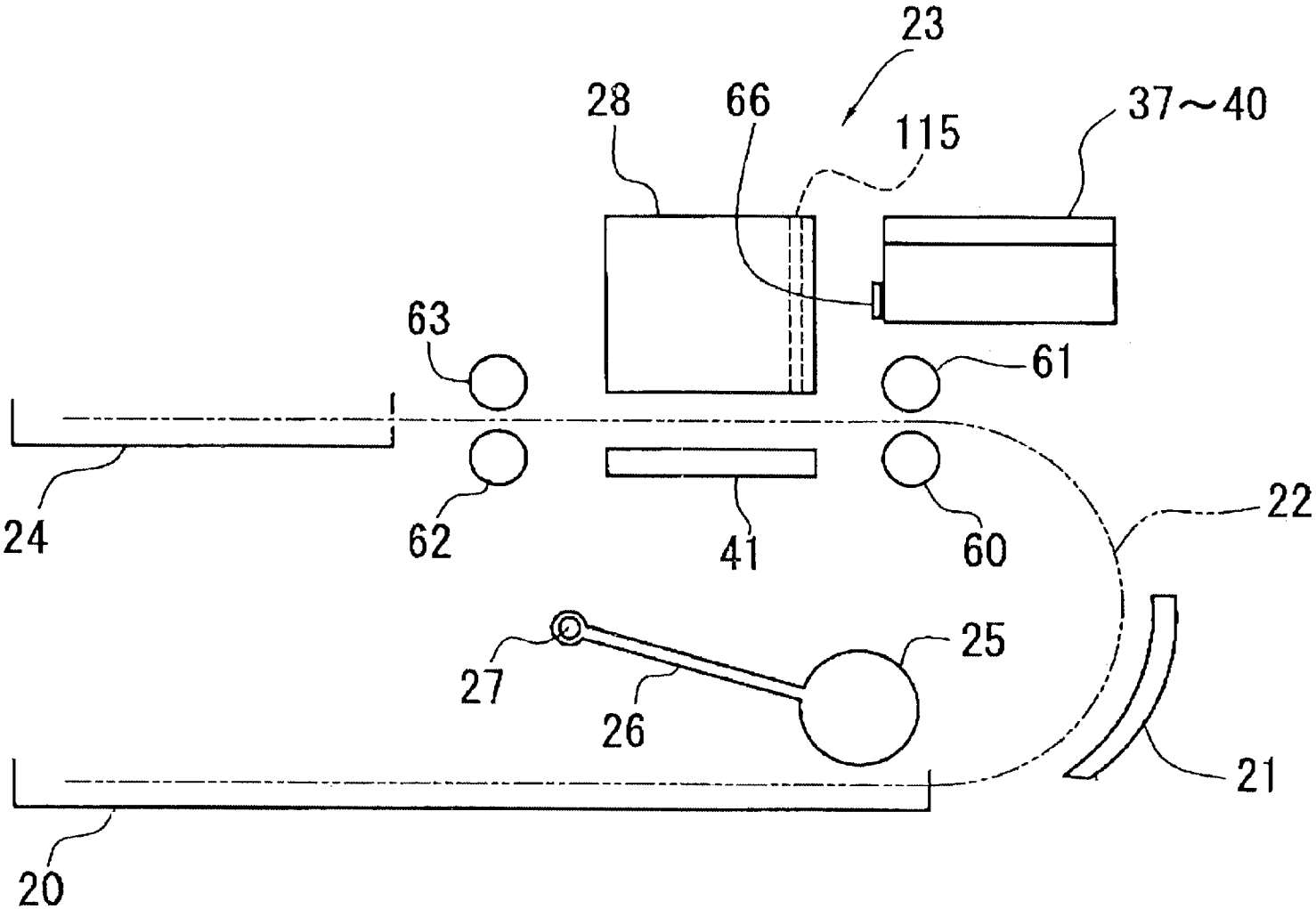
FIG. 2 is a schematic of a printer portion of the multi-functional peripheral according to the first embodiment of the present invention.

FIG. 2 is a schematic of the printer portion 11 of the multi-functional peripheral 10. In FIG. 2, a direction perpendicular to the sheet surface is the scanning direction and the width direction of the multi-functional peripheral 10.

A sheet feeding tray 20 may be provided at the bottom of the multi-functional peripheral 10. A separation inclined plate 21 configure to separate recording medium disposed on the sheet feeding tray 20 and to guide each recording medium upward may be provided at the inner side (on the right side in FIG. 2) of the sheet feeding tray 20. A conveying path 22 may be formed upward from the separation inclined plate 21. The conveying path 22 extends upward and bends to the left to extend from the back surface side to the front surface side of the multi-functional peripheral 10. Further, the conveying path 22 communicates with a sheet discharging tray 24 by passing through an image recording portion 23. Thus, a recording medium accommodated in the sheet feeding tray 20 may be guided by the conveying path 22 upward from the lower side to make a U-turn and to reach the image recording portion 23. After the image recording portion 23 performs image recording on the recording medium, the recording medium may be discharged on to the sheet discharging tray 24. A direction along the conveying path 22 is the conveying direction of the recording medium. The conveying direction and the scanning direction may be orthogonal to each other.

A sheet feeding roller 25 (conveying mechanism) may be provided above the sheet feeding tray 20. The sheet feeding roller 25 separates, one by one, recording medium disposed on the sheet feeding, tray 20 to be fed to the conveying path 22. The sheet feeding roller 25 may be a known sheet feeding roller. For example, the sheet feeding roller 25 may be axially supported at the tip edge of a sheet feeding arm 26 that moves vertically to move toward and to move away from the sheet feeding tray 20. The sheet feeding roller 25 may be coupled to a motor via a driving transmission mechanism. The driving transmission mechanism may comprise a plurality of gears that engage each other. When the motor is activated, a driving force may be transmitted to the sheet feeding roller 25, such that the sheet feeding roller 25 rotates.

The sheet feeding arm 26 may be provided rotatably about the rear anchor axis 27. Thus, the sheet feeding arm 26 may oscillate in the vertical direction using the rear anchor axis 27 as the center of oscillation. In a stand-by state, the sheet feeding arm 26 may be lifted upward by an unillustrated sheet feeding clutch, spring, or the like, and may oscillate downward when a recording medium is fed. As the sheet feeding arm 26 oscillates downward, the sheet feeding roller 25 axially supported at the tip edge may be pressed against the surface of the recording medium on the sheet feeding tray 20. The sheet feeding roller 25 rotates in this state. The recording medium at the uppermost position may be forcedly fed to the separation inclined plate 21 by a frictional force between the roller surface of the sheet feeding roller 25 and the recording medium. The tip edge of the recording medium abuts on the separation inclined plate 21 and is guided upward to be fed into the conveying path 22. When the recording medium at the uppermost position is fed by the sheet feeding roller 25, a recording medium directly beneath may be fed together with this recording medium due to friction or static electricity. However, the recording medium directly beneath is stopped as it abuts the separation inclined plate 21.

The conveying path 22 may be defined by an outer guide surface and an inner guide surface that oppose each other at a specific interval except for a portion where the image recording portion 23 and the like are provided. In the multi-functional peripheral 10, the outer guide surface may comprise the inner wall surface of the frame of the multi-functional peripheral 10, and the inner guide surface may comprise the surface of a guide member provided inside the frame of the multi-functional peripheral 10. In particular, a conveying roller (not shown) may be provided in a portion where the conveying path 22 is curved. However, the conveying roller may be provided rotatably using the width direction of the conveying path 22 (a direction perpendicular to the sheet surface of the drawing) as the rotation center axis direction. The conveying roller may be attached so that a roller surface of the conveying roller is exposed to the outer guide surface or the inner guide surface. The conveying roller conveys the recording medium smoothly even in a portion where the conveying path 22 is curved because the recording medium comes in contact with the guide surface.

Figure 3:
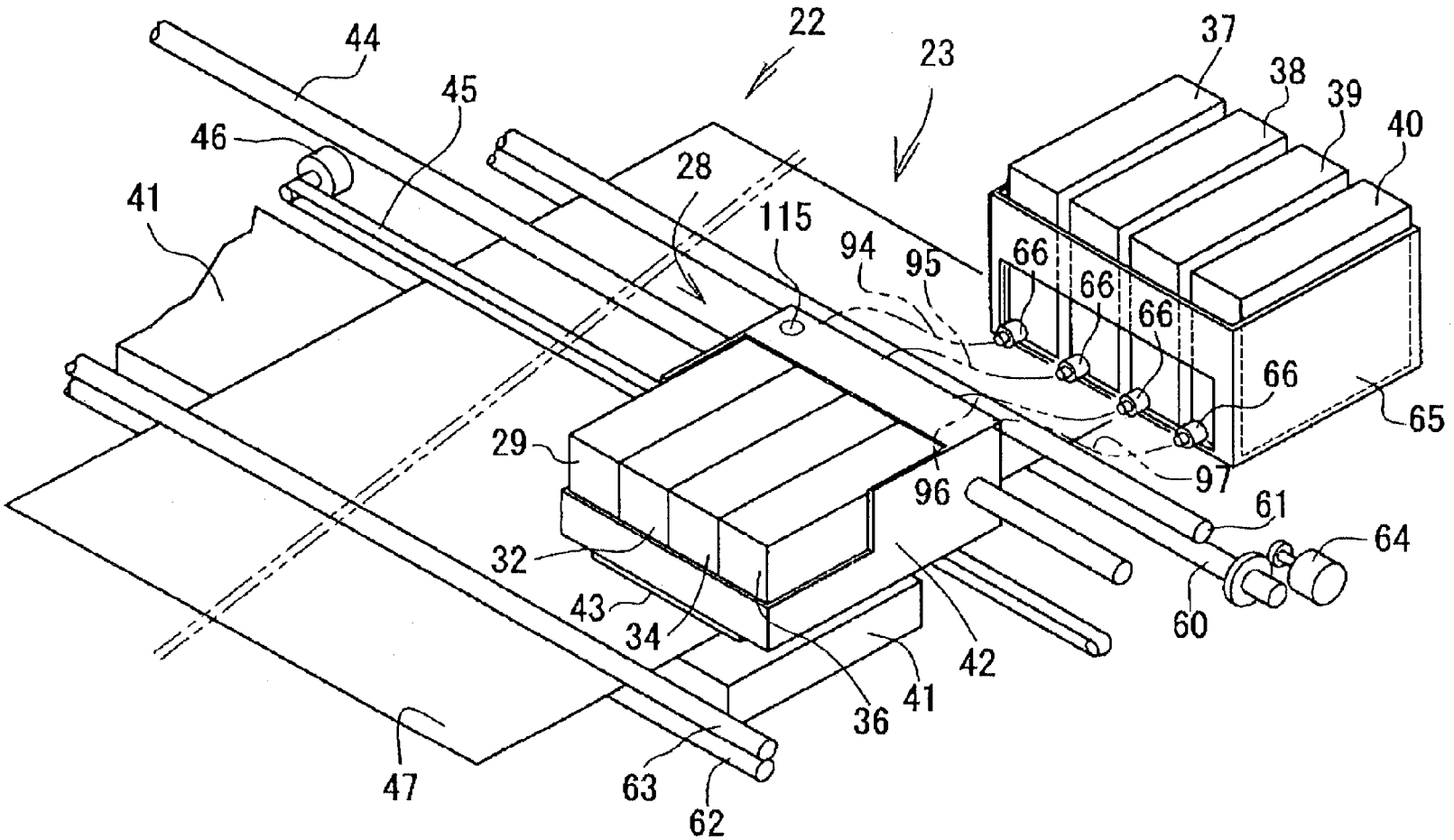
FIG. 3 is a perspective view of an image recording portion of the multi-functional peripheral according to the first embodiment of the present invention.
Figure 4:
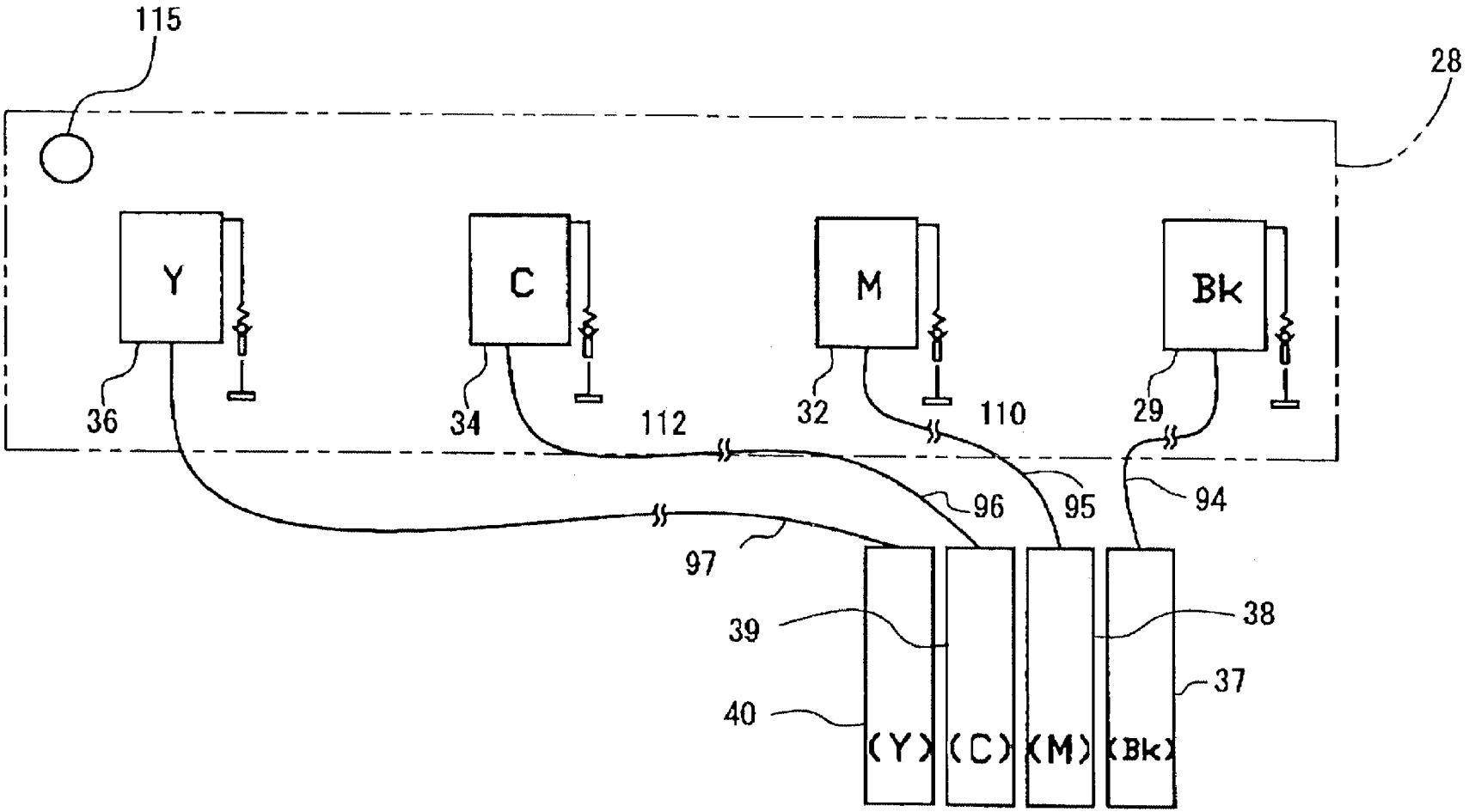
FIG. 4 is a block diagram of the image recording portion of the multi-functional peripheral according to the first embodiment of the present invention.

The image recording portion 23 may be provided on the lower stream side of the conveying path 22 after it makes a U-turn from downward to upward. FIG. 3 is a perspective view of the image recording portion 23. FIG. 4 is a block diagram of the image recording portion 23.

As shown in FIGS. 2 and 3, a driving roller 60 and a pressing roller 61 (conveying mechanism) may be provided in the upper stream side of the image recording portion 23. These driving roller 60 and the pressing roller 61 pinch a recording medium 47 being conveyed in the conveying path 22 to be fed on to a platen 41. A sheet discharging roller 62 and a pressing roller 63 (conveying mechanism) may be provided in the downstream of the image recording portion 23. The sheet discharging roller 62 and the pressing roller 63 pinch and convey the recording medium 47 during a image recording. The driving roller 60 may be driven to rotate by a motor 64, and the sheet discharging roller 62 also may be driven to rotate by the motor. The recording medium 47 is thus fed intermittently by a specific line feed width.

The pressing roller 61 may be elastically pushed toward the driving roller 60 so as to press the driving roller 60 at a specific pressing force. Therefore, when a recording medium 47 enters a space between the driving roller 60 and the pressing roller 61, the pressing roller 61 cooperates with the driving roller 60 to pinch the recording medium 47 while elastically retracting by a amount comparable to the thickness of the recording medium 47. A rotating force of the driving roller 60 may be transmitted to the recording medium 47 in a reliable manner. The pressing roller 63 may be provided in the same manner with respect to the sheet discharging roller 62. Nevertheless, because the pressing roller 63 is pressed against the recording medium 47 during the image recording, the roller surface may be formed in the form of a spur to prevent or to reduce deterioration of an image recorded on the recording medium 47.

The recording medium 47 pinched by the driving roller 60 and the pressing roller 61 may be conveyed intermittently on the platen 41 at a specific line feed width. A recording head 43 may slide in the scanning direction for each line feed of the recording medium 47, and performs image recording from the tip edge side of the recording medium 47. During the image recording, the recording medium 47 is pinched by the sheet discharging roller 62 and the pressing roller 63 from the tip edge side. In other words, the recording medium 47 is conveyed intermittently by a specific line feed width while its tip edge side is pinched by the sheet discharging roller 62 and the pressing roller 63 and the trailing edge side is pinched by the driving roller 60 and the pressing roller 61. Further, when the recording medium 47 is conveyed, the trailing edge of the recording medium 47 passes by the driving roller 60 and the pressing roller 61. The recording medium 47 is thus released from the driving roller 60 and the pressing roller 61, and is conveyed intermittently by a specific line feed width by the sheet discharging roller 62 and the pressing roller 63. In this case, the recording head 43 also performs image recording on the recording medium 47. After an image is recorded in a specific region of the recording medium 47, the sheet discharging roller 62 is driven to rotate continuously, so that the recording medium 47 pinched by the sheet discharging roller 62 and the pressing roller 63 is discharged on to the sheet discharging tray 24.

As are shown in FIGS. 2-4, the image recording portion 23 may comprise a head portion 28, the platen 41 disposed oppositely to the head portion 28, sub tanks 29 through 36 that supply ink to the recording head 43 (an ink-jet recording head in the first embodiment), ink tanks 37 through 40, e.g., ink tanks of a cartridge type, that supply ink to the sub tanks 29 through 36, a pump (not shown) for pumping ink from the respective ink tanks 37 through 40, and an unillustrated control device (controller) that controls driving of the pump and the like.

The image recording portion 23 performs image recording on the recording medium 47 conveyed on to the platen 41. More specifically, an image is recorded on the recording medium 47 as the head portion 28 slides in the scanning direction while ejecting ink of respective colors, e.g., black (Bk), magenta (M), cyan (C), yellow (Y), and the like, supplied from the ink tanks 37 through 40.

Connection tubes 94 through 97 comprising flexible tubes may be linked to the ink tanks 37 through 40, respectively. The bead portion 28 may slide in the horizontal direction in FIG. 4. The connection tubes 94 through 97 may be set to have both flexibility and a sufficient length. The connection tubes 94 through 97 are therefore allowed to undergo deformation to smoothly follow the head portion 28 that is sliding.

As is shown in FIG. 3, the bead portion 28 may be provided with a scanning carriage 42. The sub tanks 29 through 36 may be held by the scanning carriage 42. The head portion 28 may be provided with the recording head 43, and the recording head 43 also may be held by the scanning carriage 42. The recording head 43 may be disposed so as to be exposed to the lower surface of the scanning carriage 42, and ink is supplied to the recording head 43 from the sub tanks 29 through 36. The scanning carriage 42 may be supported on a guiding shaft 44, and may be configured to slide along the guiding shaft 44. An endless belt 45 may be attached to the scanning carriage 42. A belt driving motor 46 may be coupled to the endless belt 45 via a pulley, so that the head potion 28 slides in the scanning direction in association with operations of the belt driving motor 46.

The scanning carriage 42 may be provided with a media sensor 115 (detector). The media sensor 115 detects the presence and the edge position of the recording medium 47, and may comprise a light source and a light receiving element. The light source may transmit light downward. Light transmitted from the light source irradiates the surface of the recording medium 47 conveyed to the head portion 28 side. When the recording medium 47 has not been conveyed on to the platen 41, the light irradiates the platen 41. Light irradiated to the recording medium 47 or the platen 41 is reflected. The light receiving element receives the reflected light, and yields an output in response to a quantity of received light. The value of an output is indicated by a so-called AD value (voltage value). The media sensor 115 scans across the platen 41 while the scanning carriage 42 slides. The presence and the position of the edge of the recording medium 47 on the platen 41 are detected in response to a change of the AD value. Moreover, a control device 69 may judge the type (sheet type) of the recording medium 47 according to the AD value.

Although it is not shown in the drawing, a position sensor, e.g., an encoder, may be provided to the frame of the multi-functional peripheral 10. The encoder detects the position of the scanning carriage 42 on the platen 41, and transmits the position data (voltage value) to the control device 69. The CPU in the control device 69 calculates the position of the scanning carnage 42 on the platen 41 according to the position data. Therefore, when the scanning carriage 42 slides, the relative positions of the recording head 43 and the media sensor 115 with respect to the recording medium 47 may be acquired by the control device 69.

The multi-functional peripheral 10 is characterized in that the recording medium 47 is conveyed and the edge position of the recording medium 47 is sensed by the media sensor 115. The edge position of the recording medium 47 placed on the platen 41 may be detected quickly, and high-speed marginless recording may be achieved.

Figure 5:
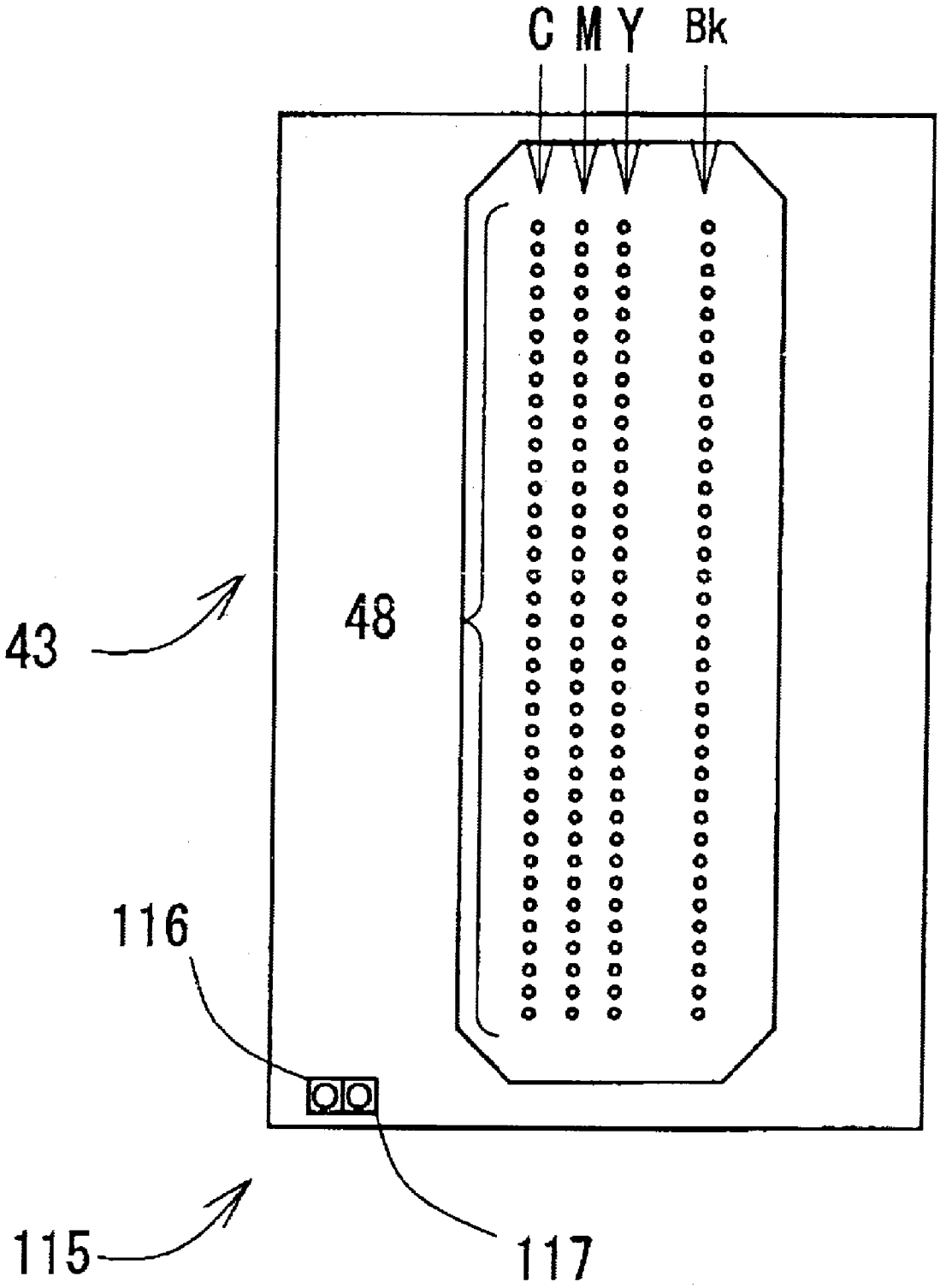
FIG. 5 is an enlarged, bottom view of a recording head in the multi-functional peripheral according to the first embodiment of the present invention.

FIG. 5 is an enlarged, bottom view of the recording head 43, and illustrates the bottom surface of the recording head 43 in detail.

As shown in FIG. 5, an ink ejection opening 48 may be provided in the lower surface of the recording head 43. In this embodiment, nozzles arrayed in four lines forming the ink ejection opening 48 are provided in parallel in the longitudinal direction. With respect to FIG. 5, the longitudinal direction means the conveying direction of the recording medium 47, and the nozzles on the right end correspond to the black ink (Bk), and the black ink (Bk ink) is ejected from the nozzles. Nozzles arrayed in three lines are provided sequentially to be adjacent to the nozzles for the Bk ink. The nozzles in the respective lines correspond to the yellow ink (Y), the magenta ink (M), and the cyan ink (C). The yellow ink (Y ink), the magenta ink (M ink), and the cyan ink (C ink) are ejected from these nozzles. In this embodiment, the recording head 43 may eject ink of four different colors. In addition, the light source 116 and the light receiving element 117 of the media sensor 115 may be exposed to the lower surface of the recording head 43. Light transmitted from the light source 116 may be reflected on the recording medium 47 or the like, and the reflected light is received by the light receiving element 117.

Figure 6:
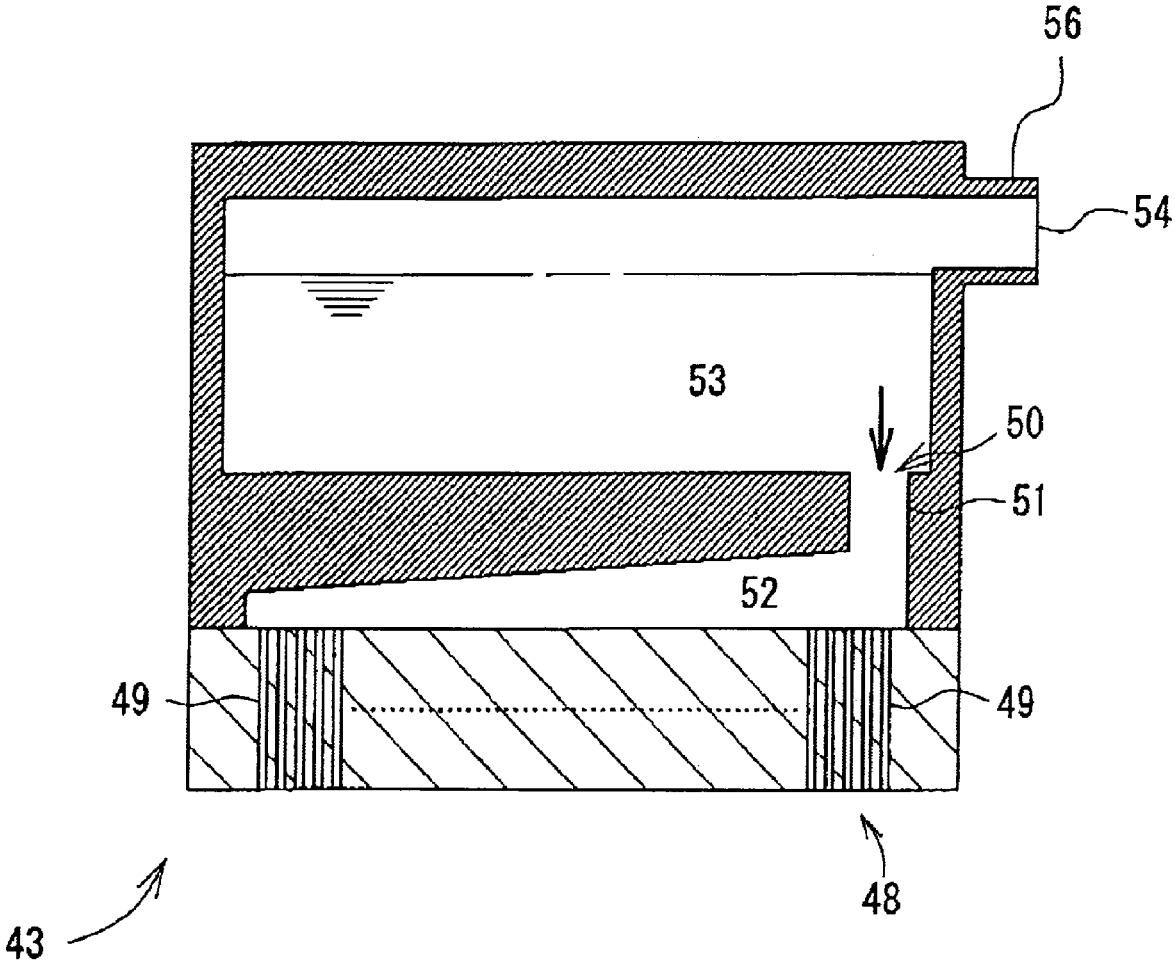
FIG. 6 is a cross-sectional view of a head portion in the multi-functional peripheral according to the first embodiment of the present invention.

FIG. 6 is a cross-sectional view of the head portion 28.

As is shown in FIG. 6, a plurality of nozzles 49 forming the ink ejection opening 48 may be aligned to correspond to the respective color ink, Bk, Y, M, and C, at the lower portion of the recording head 43. A manifold 50 may be formed upstream from the nozzles 49 for each color ink. The manifold 50 may comprise a supply tube 51 formed on one side of the nozzles 49, and a manifold chamber 52 formed continuously from the nozzles 49. The ink supplied from the supply tube 51 may be distributed to the respective nozzles 49 through the manifold chamber 52.

The surface of the manifold chamber 52 that opposes the nozzles 49 may be inclined to descend in the lower stream side to which the ink flows, and the sectional area of the manifold chamber 52 may be formed to be smaller little by little toward the lower stream side. Various known mechanisms may be adopted as the mechanism to eject ink distributed by the manifold 50. For example, a mechanism in which the side wall of the nozzle 49 is made of a piezoelectric material and ink drops are ejected by deformation of the piezoelectric material may be adopted as the mechanism to eject ink.

A buffer tank 53 may be provided above the manifold 50. Similar to the nozzles 49 and the manifolds 50, the buffer tank 53 may be provided to correspond to each color ink. The buffer tank 53 may form the respective sub tanks 29 through 36, either partially or entirely. Ink within the ink tanks 37 through 40 may be supplied to the respective tanks 29 through 36 via an ink supply opening 54. In general, the ink is not supplied directly to the nozzles 49 from the ink tanks 37 through 40, and instead, the ink is temporarily stored in the buffer tanks 53 (sub tanks 29 through 36). Therefore, bubbles generated in the ink may be removed, and it becomes possible to prevent air bubbles from entering the nozzles 49. Also, air bubbles trapped within the buffer tanks 53 (sub tanks 29 through 36) may be removed from an unillustrated air bubble discharge outlet.

Each of the sub tanks 29 through 36 (buffer tanks 53) that correspond to the respective color ink (Bk, Y, M, and C) may be provided with a fitting portion 56. The ink supply opening 54 may be provided in the fitting portion 56. The connection tubes 94 through 97 formed of flexible tubes may be coupled linked to the fitting portions 56 (see FIG. 3). Therefore, as is shown in FIG. 4, the ink tank 37 may be connected to the sub tank 29 via the connection tube 94, the ink tank 38 may be connected to the sub tank 32 via the connection tube 95, the ink tank 39 may be connected to the sub tank 34 via the connection tube 96, and the ink tank 40 may be connected to the sub tank 36 via the connection tube 97.

As is shown in FIG. 3, the ink tanks 37 through 40 may be held by a holder 65. The ink tanks 37 through 40 may reserve the Bk ink, the M ink, the C ink, and the Y ink, respectively. Connection portions 66 connected to the fitting portions 56 of the sub tanks 29 through 36 (see FIG. 6) may be provided at the lower portion of the ink tanks 37 through 40, respectively. The connection tubes 94 through 97 may be coupled to the connection portions 66.

When the pump is activated, the Y ink is pumped from the ink tank 40 and is sent to the sub tank 36 via the connection tube 97. Likewise, the C ink is supplied to the sub tank 34 from the ink tank 39, the M ink is supplied to the sub tank 32 from the ink tank 38, and the Bk ink is supplied to the sub tank 29 from the ink tank 37. Moreover, because the respective sub tanks 29 through 36 (buffer tanks 53) communicate with the manifold chambers 52 via the supply tubes 51 (see FIG. 6), the respective color ink supplied from the ink tanks 37 through 40 flow into the nozzles 49 by passing through the sub tanks 29 through 36 (buffer tanks 53) and the manifolds 50. The recording head 43 ejects the respective color ink from the ink ejection opening 48 in the form of ink drops.

Figure 7:
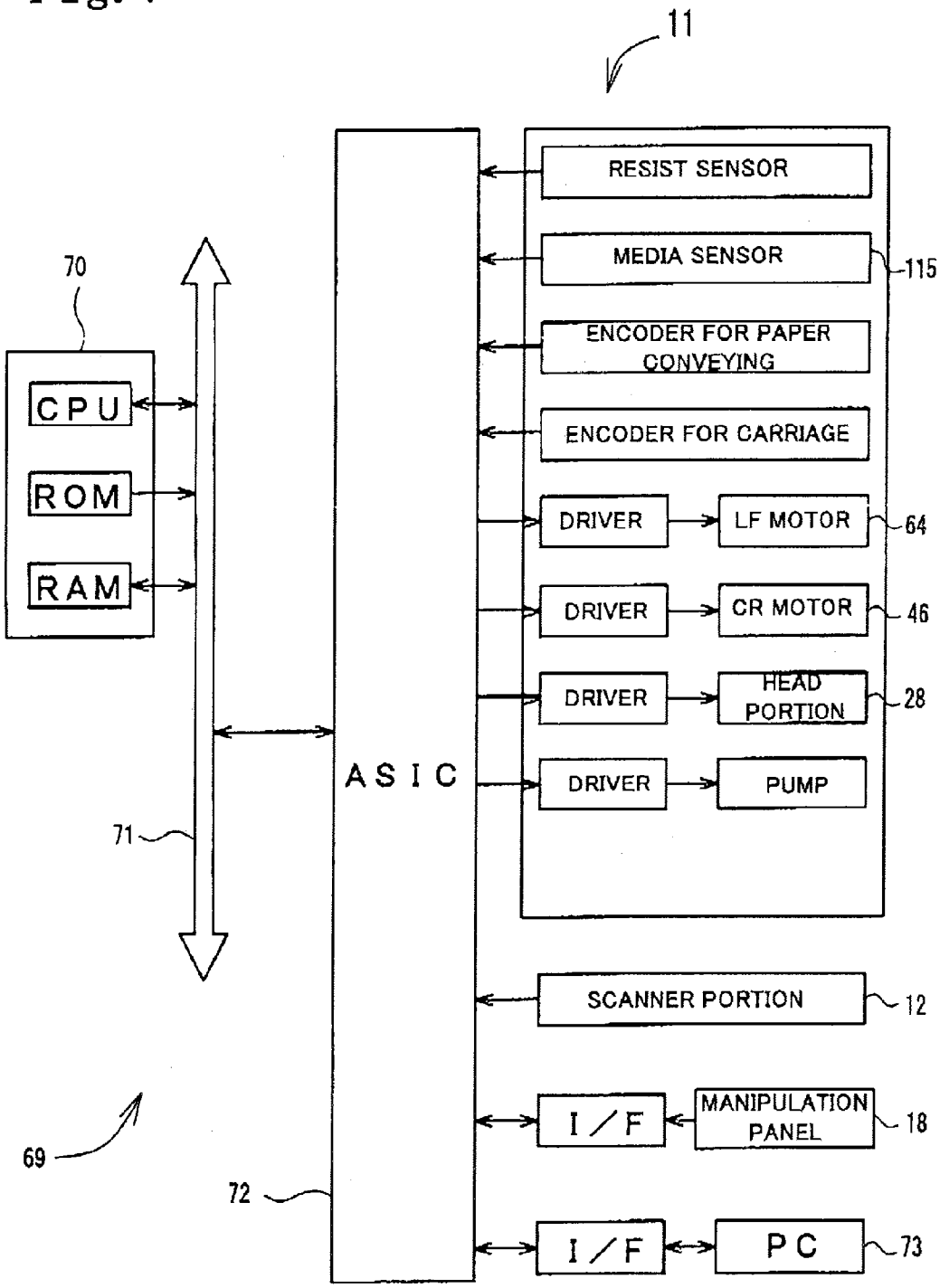
FIG. 7 is a block diagram of a control device in the multi-functional peripheral according to the first embodiment of the present invention.

FIG. 7 is a block diagram showing the control device 69 in the multi-functional peripheral 10.

As is shown in FIG. 7, the control device 69 may comprise a central processing portion 70 provided with a CPU (Central Processing Unit), a ROM (Read Only Memory), and a RAM (Random Access Memory), and the central processing portion 70 may be connected to various sensors, the printer portion 11, the scanner portion 12, the manipulation portions 18, and the like via a bus 71 and an ASIC (Application Specific Integrated Circuit) 72 to enable data reception and transmission.

The ROM in the central processing portion 70 pre-stores a specific computer program. The CPU performs various calculations according to information from various sensors in accordance with the computer program. Accordingly, the rotation control of the motor 64, e.g., a LF motor, serving as a driving source of the driving roller 60, the rotation control of the belt driving motor 46, e.g., a CR motor, to slide the head portion 28, the operation control of the pump to pump up the ink from the ink tanks 37 through 40, the judgment of the presence of the recording medium 47 on the platen 41 according to the information (AD value) transmitted from the media sensor 115, and other specific calculations may be performed.

The CPU detects a presence and an edge position of the recording medium 47 on the platen 41 according to the information (AD value) from the media sensor 115. That is, as the scanning carriage 42 starts scanning, the media sensor 115 moves above the recording medium 47 to sense the presence of the recording medium 47. The platen 41 normally is set to a hue of low brightness, and the recording medium 47 normally is set to a hue of high brightness, e.g., white. Therefore, when the media sensor 115 senses the recording medium 47, the AD value as the measured value changes abruptly at the edge of the recording medium 47 (the boundary of the Platen 41 and the recording medium 47). Such a change of the AD value is judged by the CPU in the control device 69. Because the position of the media sensor 115 is acquired by the encoder, for example, by every 1/150 inch, when the position of the media sensor 115 on the platen 41 and the AD value are detected, the presence and the edge of the recording medium 47 are acquired by setting a predetermined threshold value of the AD value. A position of one edge (a first position of a first edge) in the scanning direction and a position of the other edge (a second position of a second edge) in the scanning direction are detected based on the positions of the media sensor 115 when each one of the edges of the recording medium 47 is detected. Moreover, the CPU judges the sheet type of the recording medium 47 according to the information (AD value) from the media sensor 115 in accordance with the computer program installed in the ROM. For example, the CPU may judge the sheet type of the recording medium 47 according to a quantity of received light on the light receiving element.

The position of one edge in the scanning direction and the position of the other edge in the scanning direction of the recording medium 47 may be detected in a leading edge detection region and an intermediate detection region of the recording medium 47. The leading edge detection region is a detection region in which the positions of the one and the other edge of the recording medium 47 are detected quantitatively, and it is the leading edge position of the recording medium 47 in the conveying direction. Also, the intermediate detection region is set at every predetermined distance (for example, ¼ inch) in the conveying direction rearward in reference to the leading edge detection region. Further, the CPU also may determine an amount of skew of the recording medium 47 by calculations according to the position of one edge in the scanning direction and the position of the other edge in the scanning direction detected in the leading edge detection region and plurality of intermediate detection regions.

The position of one edge in the scanning direction and the position of the other edge in the scanning direction at the respective detection region, an amount of skew of the recording medium 47, the sheet type, and the sheet size may be correlated with one another and may be stored in the RAM (storing unit). In other words, the sheet type information, the sheet size information, and edge position information comprising the position of one edge in the scanning direction and the position of the other edge in the scanning direction in the leading edge detection region, and the position of one edge in the scanning direction and the position of the other edge in the scanning direction in the respective intermediate detection region may comprise information about the recording medium 47. In this case, an amount of skew may be included in the edge position information. The CPU may control the head portion 28 according to the foregoing information.

Besides an input from the manipulation panel 18, the multi-functional peripheral 10 may be connected to a personal computer (PC) 73, so that the multi-functional peripheral 10 records an image and a document on the recording medium 47 according to image data and document data transmitted from the computer 73. The multi-functional peripheral 10 may be provided with an interface (I/F) to enable data reception and transmission with the personal computer 73. The configuration of the control device 69 shown in this embodiment is one example, and those of ordinary skill in the art readily will understand that other configurations may be adopted.

Figure 8:
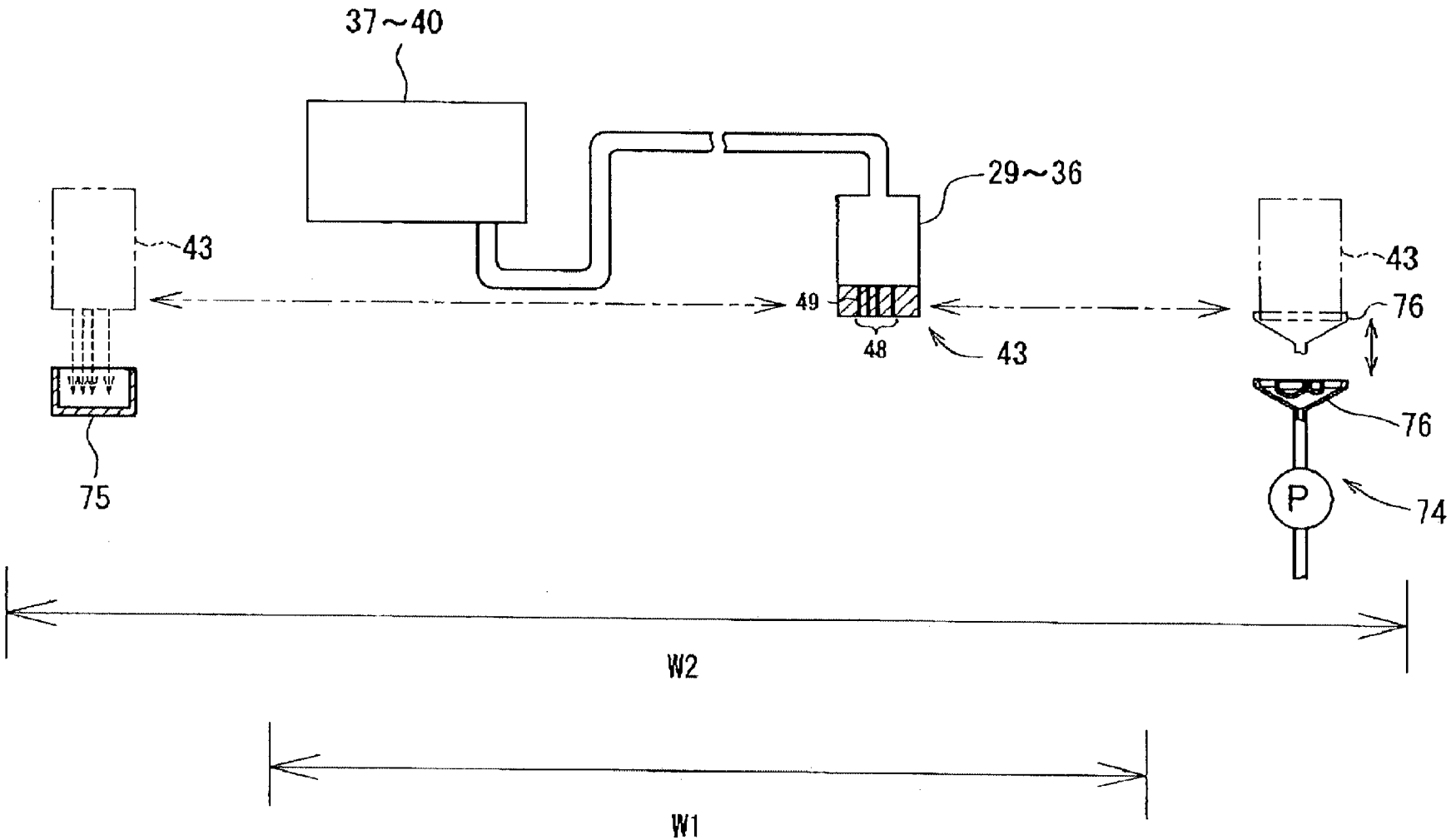
FIG. 8 is a schematic of an ink supply path and an operation position of the recording head in the multi-functional peripheral according to the first embodiment of the present invention.

FIG. 8 is a schematic showing an ink supply path through which the ink is sent from the ink tanks 37 through 40 to the recording head 43 by way of the sub tanks 29 through 36, and an operation position of the recording head 43.

The ink supplied from the ink tanks 37 through 40 is reserved in the sub tanks 29 through 36 (buffer tanks 53, see FIG. 6) to trap air bubbles in the ink. The ink is distributed to the nozzles 49 by flowing into the manifold chambers 52 from the supply tubes 51 (see FIG. 6), and being ejected from the ink ejection opening 48 in the form of ink drops. An image is recorded on the recording medium 47 conveyed below the recording head 43 as the recording head 43 passes across an image recording range W1 while ejecting ink drops of the respective color ink.

As is shown in FIG. 8, a purge mechanism 74 and a wasted ink tray 75 may be provided respectively at the both edges of a scan enabled range W2 that are outside the image recording range W1 of the recording head 43. The purge mechanism 74 sucks air bubbles and foreign materials from the nozzles 49 and the like of the recording head 43, and may be provided with the pump. When the recording head 43 slides to the right end (purge position) in the scan enabled range W2, a cap 76 of the purge mechanism 74 moves upward, and the cap 76 adheres closely to the lower surface of the recording head 43 to cover the ink ejection opening 48. The pump may be connected to the cap 76. When the pump operates, the ink is sucked from the nozzles 49 or the like of the recording head 43 and is sent to the respective sub tanks 29, 32, 34, and 36. In the multi-functional peripheral 10 according to this embodiment, the ink tanks 37 through 40 communicate with the outside, and internal pressures of the ink tanks 37 through 40 are equal to an atmosphere pressure. Moreover, the recording head 43 may be provided below the ink tanks 37 through 40. Therefore, as the recording head 43 ejects ink, the ink within the ink tanks 37 through 40, in which an atmospheric pressure exerts, may be supplied continuously to the recording head 43 via the connection tubes 94 through 97, respectively (see FIG. 4). Further, the control device 69 performs the control of the belt driving motor 46 to slide the recording head 43, the control of movements of the cap 76, and the control of the pump.

The wasted ink tray 75 receives idle ejection of ink from the recording head 43.

Such idle ejection of ink generally is referred to as flushing. In the case of flushing, the recording head 43 is moved to the left end (flushing position) in the scanning enabled range W2, and the respective color ink is ejected idly toward the wasted ink tray 75 at this position. The positions of the purge mechanism 74 and the wasted ink tray 75 in the horizontal direction are not particularly limited. They may be reversed left to right from the positions described above in the scanning enabled range W2, or both may be disposed to either side alone.

In this embodiment, when the scanning carriage 42 is positioned at the flushing position (the left end in FIG. 8), the encoder is set to an initial value (origin). The encoder may be set to the origin when the scanning carriage 42 is positioned at the purge position (the right end in FIG. 8). The reference position of the scanning carriage 42 is set when the scanning carriage 42 may be at the purge position or the flushing position.

The holder 65 holding the ink tanks 37 through 40 (see FIG. 3) may be provided, for example, at the right end in the scanning enabled range W2. Nevertheless, the holder 65 alternatively may be provided at the left end in the scanning range W2, or in a dead space of the frame of the multi-functional peripheral 10.

Figure 9:
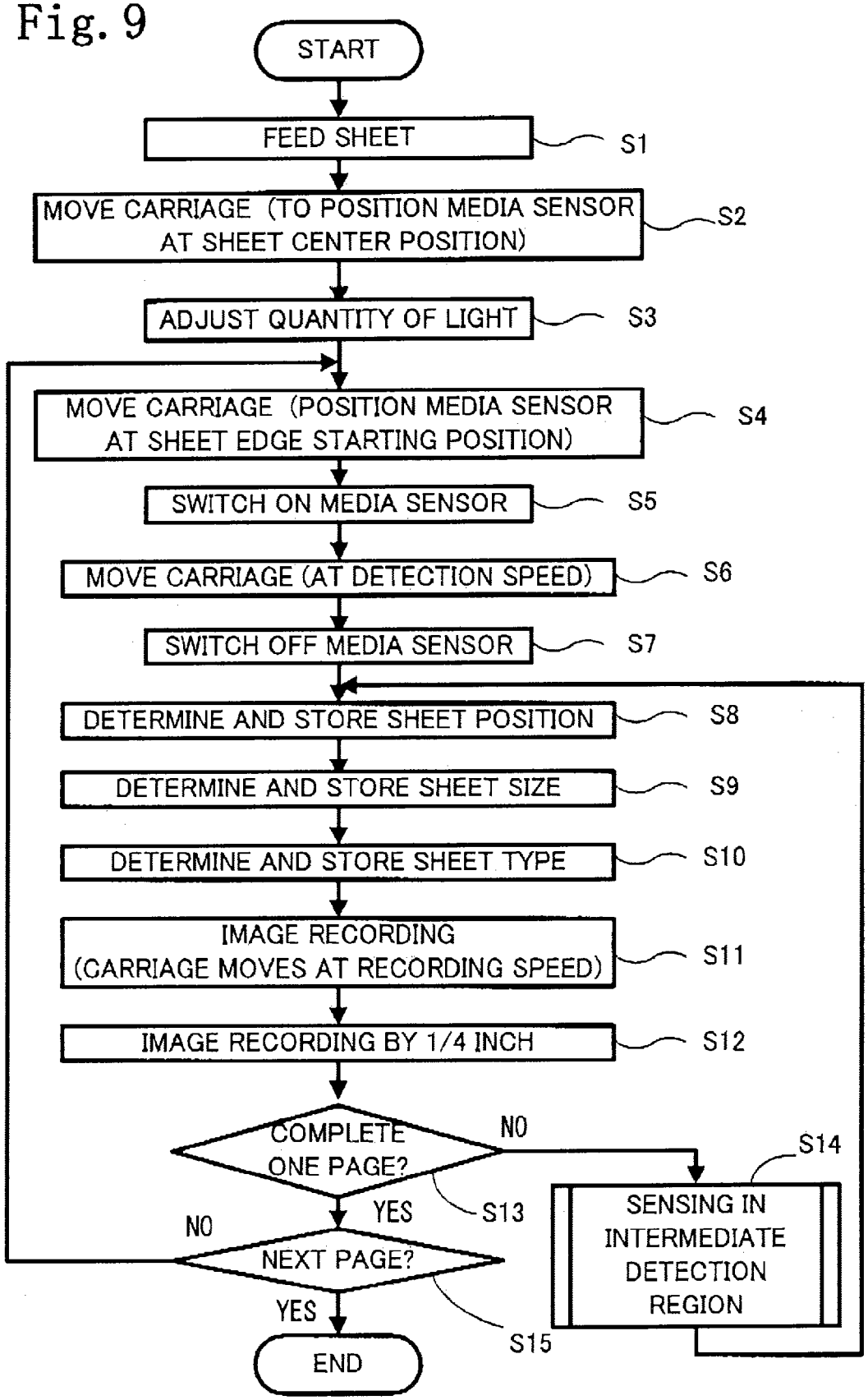
FIG. 9 is a flowchart of a recording procedure by the multi-functional peripheral according to the first embodiment of the present invention.

FIG. 9 is a flowchart detailing the recording procedure by the multi-functional peripheral 10 according to this embodiment. The multi-functional peripheral 10 may record an image on the recording medium 47 according to the following procedure.

When recording is started according to specific image data a first recording medium 47 is fed (Step S1). The recording medium 47 is fed by the sheet feeding roller 25 (see FIG. 2), and is conveyed through the conveying path 22 by the driving roller 60 and the sheet discharging roller 62. The recording medium 47 is conveyed to a specific position, and is set to be ready for image recording. For example, the specific position may be a position immediately before the head portion 28, and it is a position at which the media sensor 115 may detect the side edge at the leading edge of the recording medium 47.

Subsequently, the scanning carriage 42 is moved (Step S2). Thus, the media sensor 115 is positioned at the center of the recording medium 47. Because the position of the media sensor 115 is acquired by the encoder, the media sensor 115 may be readily positioned at the center of the recording medium 47. Light is transmitted from the light source of the media sensor 115 toward the recording medium 47, and the light receiving element receives the reflected light. The light receiving element then outputs a signal (AD value) in response to a amount of received light. The CPU in the control device 69 adjusts a quantity of light of the light source according to the AD value (Step S3). In other words, the adjustment of a quantity of light of the light source is performed according to the type of the recording medium 47. The CPU may judge the sheet type of the recording medium 47 according to the AD value simultaneously while a quantity of light is adjusted.

Subsequently, the scanning carriage 42 is moved (Step S4). Thus, the media sensor 115 is positioned at the detection starting position to detect the edge of the recording medium 47. To be more specific, the scanning carriage 42 is positioned at the flushing position (the left end in FIG. 8). The encoder is set to the origin at the flushing position. Subsequently, the media sensor 115 is switched ON and is set to detect the edge of the recording medium 47 (Step S5).

Subsequently, the scanning carriage 42 is moved (Step S6). The moving direction of the scanning carriage 42 is a direction heading from the left to the right in FIG. 8. In this instance, the scanning carriage 42 is moved at a specific detection rate. For example, the detection speed may be set between 4 inches/sec and 20 inches/sec. When the detecting in the leading edge detection region ends, the media sensor 115 is switched OFF (Step S7).

In other words, prior to the image recording, the position of one edge in the scanning direction and the position of the other edge in the scanning direction of the recording medium 47 in the leading edge detection region are detected. Specifically, the scanning carriage 42 is slid (see FIG. 3), and the recording medium 47 is detected by the media sensor 115. The control device 69 detects the presence and the position of one edge in the scanning direction and the position of the other edge in the scanning direction of the recording medium 47 according to the AD value, which is an output of the media sensor 115. The position of one edge in the scanning direction and the position of the other edge in the scanning direction in the leading edge detection region are stored in the RAM in the control device 69 as the edge position information of the recording medium 47 (Step S8). The sheet size of the recording medium 47 is inputted, for example, from the manipulation panel 18 (see FIG. 1), and is stored in the RAM as the sheet size information (Step S9). Further, the control device 69 judges the sheet type of the recording medium 47 based on the quantity of received light of the reflected light that the media sensor 115 received from the recording medium 47, and stores the sheet type in the RAM as the sheet type information (Step S10). The RAM may correlate the edge position information, the sheet type information, and the sheet size information with one another, and may store them as a group of information about the recording medium 47.

An image is recorded on the recording medium 47 as ink drops are ejected from the recording head 43 while the scanning carriage 42 is slid (Step S11). In this example, image recording is performed by a conveying distance (feeding amount), which is ¼ inch (Step S12). The recording by ¼ inch does not necessarily coincide with a printing line fed width. A feeding amount of ¼ inch may therefore include several line feed operations.

Whether image recording on the recording medium 47 is completed is judged later (Step S13). When the recording medium 47 is further subjected to recording, the sensing in the intermediate detection region is performed (Step S14). When image recording on the recording medium 47 has been completed, whether image recording is to be performed continuously on another recording medium 47 is judged (Step S15). When image recording is to be performed continuously, Step S4 through Step S14 are repeated, and when image recording is not to be performed continuously, the image recording operation is complete.

Figure 10:
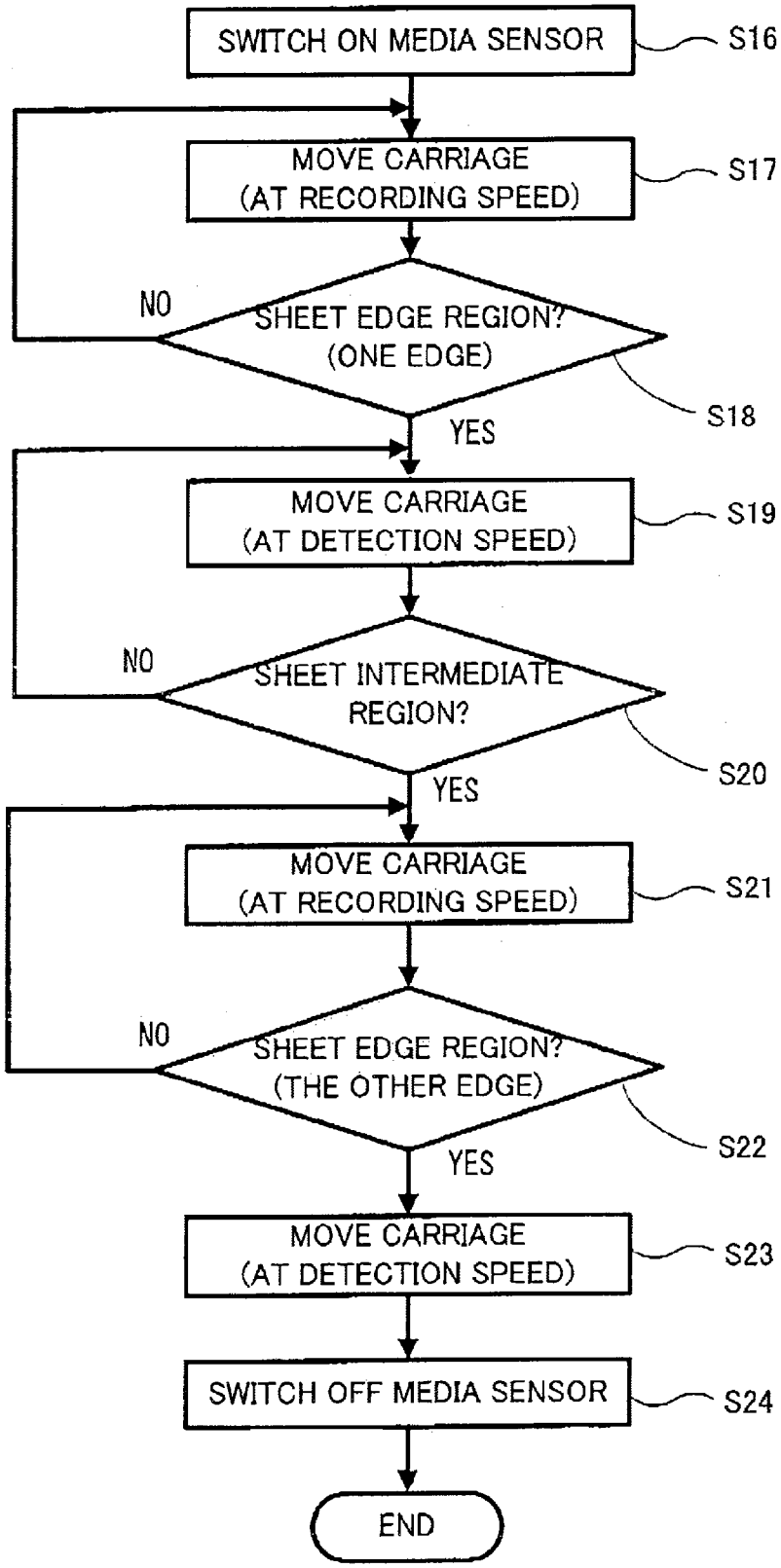
FIG. 10 is a flowchart of a portion of the recording procedure by the multi-functional peripheral according to the first embodiment of the present invention.

FIG. 10 is a flowchart showing a procedure for sensing in the intermediate detection region.

In a case where image recording is to be performed continuously after image recording is performed by ¼ inch from the leading edge of the recording medium 47, the media sensor 115 is activated (Step S16), and all is set to perform sensing in the intermediate detection region of the recording medium 47. The intermediate detection region referred to herein are detection region set at every predetermined distance, e.g., ¼ inch, in the conveying direction rearward in reference to the leading edge detection region. In this embodiment, more than one intermediate detection region is set. The scanning carnage 42 is then moved (Step S17). The moving direction of the scanning carriage 42 is a direction heading from the left to the right in FIG. 8. In this instance, the carriage 42 is moved at a predetermined recording speed. For example, the recording speed may be between 4 inches/sec and 40 inches/sec.

While the scanning carriage 42 is moving, the media sensor 115 judges whether it is at the position in a sheet edge region of the recording medium 47 (Step S18). The sheet edge region referred to in this case means a region in the vicinity of one edge of the recording medium 47 in the scanning direction. A judgment as to being in the sheet edge region is made according to the edge position information of the recording medium 47 detected in the leading edge detection region. In other words, assuming that the edge position of the recording medium 47 in the leading edge detection region almost coincide with the edge positions of the recording medium 47 in the intermediate detection region, the CPU in the control device 69 computes the vicinity of the edge positions in the intermediate detection region. When the media sensor 115 is not positioned in the region in the vicinity of one edge in the scanning direction (for example, when the media sensor 115 is positioned above the platen 41), the scanning carriage 42 keeps moving at the recording speed (Step S17). Moreover, when the media sensor 115 is positioned in the region in the vicinity of one edge in the scanning direction, the scanning carriage 42 is less down, and is moved at the detection speed that is slower than the recording speed (Step S19).

Subsequently, while the scanning carriage 42 is moving at the detection speed, whether the media sensor 115 is positioned in a sheet intermediate region is judged (Step S20). The sheet intermediate region referred to herein means a region other than the sheet edge region. For example, the sheet interminate region may be a region other than the region in the vicinity of one edge in the scanning direction and the region in the vicinity of the other edge in the scanning direction. Whether the media sensor 115 is positioned in the sheet intermediate region is judged according to the edge position information of the recording medium 47 detected in the leading edge detection region. When the media sensor 115 is positioned neither in the region in the vicinity of one edge in the scanning direction nor in the region in the vicinity of the other edge in the scanning direction, the media sensor 115 is judged as being positioned in the sheet intermediate region.

When the media sensor 115 is not positioned in the sheet intermediate region, the scanning carriage 42 keeps moving at the detection speed (Step S19). Moreover, when the media sensor 115 is positioned in the sheet intermediate region, the scanning carriage 42 is accelerated to move at the recording speed that is greater than the recording speed (Step S21).

Subsequently, while the scanning carriage 42 is moving at the recording speed, whether the media sensor 115 is positioned in a sheet edge region of the recording medium 47 is judged (Step S22). The sheet edge region referred to in this case means a region in the vicinity of the other edge of the recording medium 47 in the scanning direction. A judgment as to being in the sheet edge region is made according to the edge position information of the recording medium 47 detected in the leading edge detection region. When the media sensor 115 is not positioned in the region in the vicinity of the other edge of the scanning direction, the scanning carriage 42 keeps moving at the recording speed (Step S21). Moreover, when the media sensor 115 is positioned in the region in the vicinity of the other edge in the scanning direction, the scanning carriage 42 is moved at the detection speed that is less than the recording speed (Step S23). When the sensing in the intermediate detection region ends later, the media sensor 115 is deactivated (Step S24), and Step S8 is performed (see FIG. 9).

The scanning carriage 42 is moved at the detection speed in the vicinity of one edge in the scanning direction and in the vicinity of the other edge in the scanning direction of the recording medium 47 in the intermediate detection region, and is moved at the recording speed in the sheet intermediate region. The media sensor 115 is therefore moved at a low speed in the vicinity of one edge in the scanning direction and in the vicinity of the other edge in the scanning direction, so that the recording medium 47 may be detected precisely. As a result, the edge position of the recording medium 47 may be detected at high accuracy. Moreover, because the media sensor 115 is moved at a high speed in a region other than the region in the vicinity of one edge in the scanning direction and in the vicinity of the other edge in the scanning direction, the sensing of the recording medium 47 is performed quickly.

Steps S8 through Step S13 (see FIG. 9) are the same as described above. In other words, the position of one edge in the scanning direction and the position of the other edge in the scanning direction in the intermediate detection region detected in accordance with the procedure described above are stored in the RAM in the control device 69 as the edge position information of the recording medium 47 (Step S8). The sheet size of the recording medium 47 is inputted from the manipulation panel 18 (see FIG. 1), and is stored in the RAM as the sheet size information (Step S9). Further, the control device 69 judges the sheet type of the recording medium 47 according to a quantity of received light of the refected light that the media sensor 115 has received from the recording medium 47, and stores the sheet type in the RAM as the sheet type information (Step S10). The RAM may correlate the edge position information, the sheet type information, and the sheet size information with one another, and may store them as a group of information about the recording medium 47.

An image is recorded on the recording medium 47 as ink drops are ejected from the recording head 43 later while the scanning carriage 42 is being slid (Step S11). In this instance, image recording may be performed by the conveying distance (feeding amount), which may be ¼ inch (Step S12). In this case, the recording by ¼ inch does not necessarily coincide with the printing line feed width. A feeding amount of ¼ inch may therefore include a plurality of line feed operations. Subsequently, whether the image recording on the recording medium 47 is completed is judged (Step S13). When the recording medium 47 is further subjected to recording, detecting in the intermediate detection region is performed in the same manner as above (Step S14). When image recording on the recording medium 47 has been completed, whether image recording is to be performed continuously on another recording medium 47 is judged (Step S15). When image recording is to be performed continuously, Step S4 through Step S14 are repeated, and when image recording is not to be performed continuously, the image recording operation is complete.

In the multi-functional peripheral 10 according to this embodiment, when an image is recorded on the recording medium 47, precise detection is first performed across the recording medium 47 in the scanning direction in the leading edge detection region that the position of one edge in the scanning direction and the position of the other edge of the scanning direction are detected accurately. The position of one edge in the scanning direction and the position of the other edge in the scanning direction are stored in the RAM in the control device 69 as the edge position information. An image is recorded as the recording head 43 operates according to the edge position information. Also, in the intermediate detection region of the recording medium 47, the position of one edge in the scanning direction and the position of the other edge in the scanning direction in the sheet edge region alone may be detected precisely according to the edge position information in the leading edge detection region. In other words, in the intermediate detection region of the recording medium 47, precise detection may be performed in the sheet edge region alone without performing precise detection across the recording medium 47 in the scanning direction. Therefore, the sensing of the entire recording medium 47 may be performed quickly while the edge position of the recording medium 47 is detected at high accuracy. High-speed printing is thus enabled even when so-called marginless recording is performed.

Figure 11:
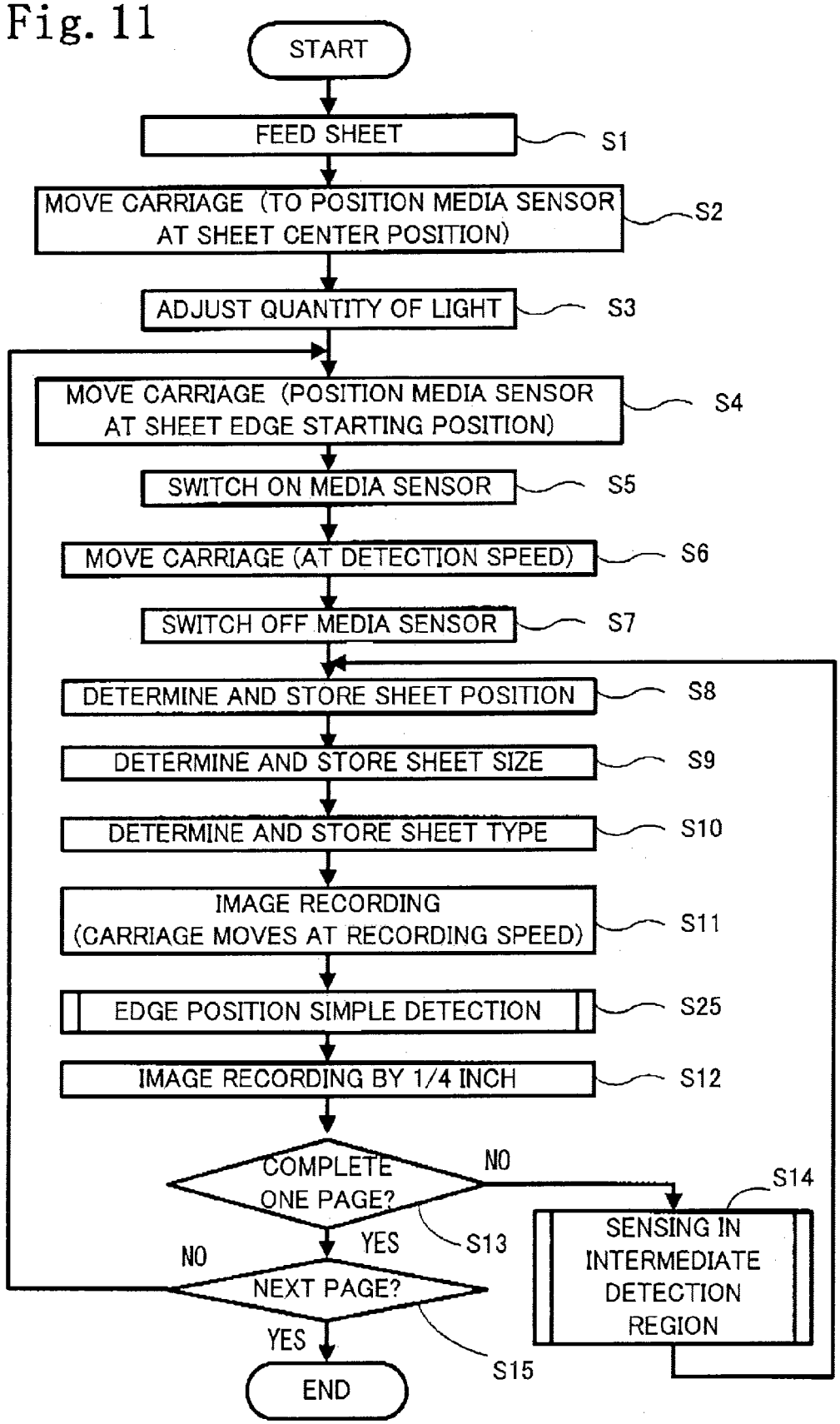
FIG. 11 is a flowchart of a recording procedure by the multi-functional peripheral according to a second embodiment of the present invention.

FIG. 11 is a flowchart of a recording procedure by the multi-functional peripheral 10 according to a second embodiment of the present invention. The recording procedure of the second embodiment is substantially the same as the recording procedure of the first embodiment, except that while the media sensor 115 stays OFF while image recording is taking place (Step S11 and Step S12) in the first embodiment, the media sensor 115 stays ON and the edge position of the recording medium 47 is detected (Step S25) while image recording is taking place in the second embodiment. Therefore, only the differences between the second embodiment and the first embodiment are discussed with respect to the second embodiment.

Figure 12:
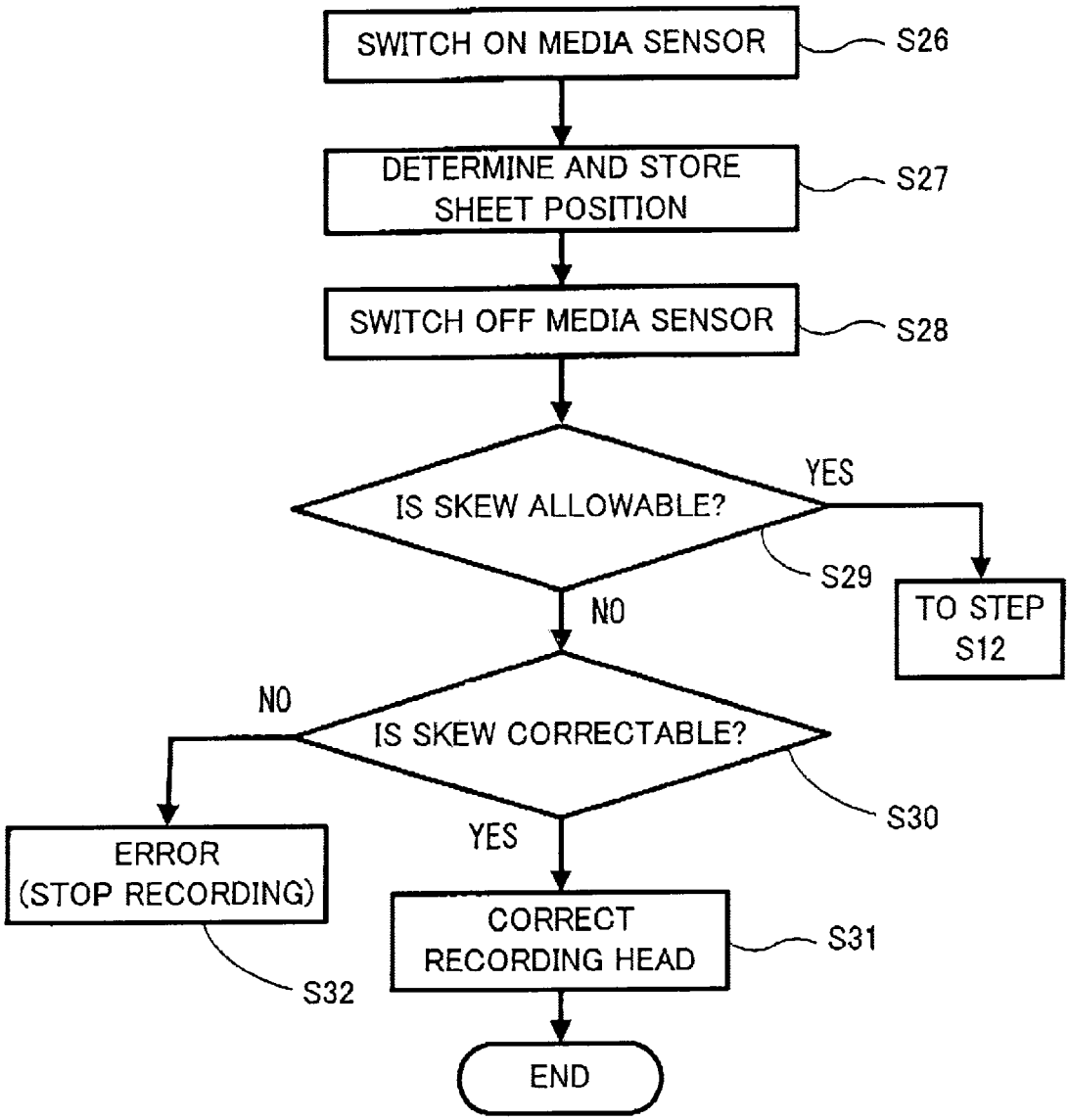
FIG. 12 is a flowchart of a portion of the recording procedure by the multi-functional peripheral according to the second embodiment of the present invention.

FIG. 12 is a flowchart of a procedure for edge position detection during the image recording according to the second embodiment.

In the second embodiment, as in the first embodiment, the recording medium 47 is fed, and an image is recorded according to the detecting at the leading edge detection position and the edge position detected precisely by the sensing (Step S1 through Step S11). As is shown in FIG. 12, the media sensor 115 is activated simultaneously with the image recording (Step S26). The AD value outputted from the media sensor 115 is stored in the RAM in the control device 69 (Step S27). When the image recording ends, the media sensor 115 is deactivated temporarily (Step S28). In this instance, because the scanning carriage 42 is moved at the recording speed (for example, 40 inches/sec), the media sensor 115 may detect the edge at lower accuracy than in a case where the scanning carriage 42 is moved at the detection speed (for example, 20 inches/sec) (simple detection). However, the edge information of the recording medium 47 is updated or the edge information is added as new information at the time of image recording.

The CPU in the recording device 69 calculates an amount of skew during the image recording on the recording medium 47 according to the edge position information stored in the RAM. Whether the amount of skew is allowable in the image recording operation is then judged (Step S29). When the amount of skew is less than a predetermined amount of skew, and is therefore allowable in the image recording operation, the image recording is continued (Step S12, see FIG. 11). Moreover, when the amount of skew is not allowable, the recording head 43 is corrected according to the amount of skew (Step S30). Specifically, ejection timing of ink drops from the recording head 43 is corrected for the ink drops to be ejected to match with the edge position of the recording medium 47, after which the image recording is continued (Step S12, see FIG. 11). When the amount of skew is too large and it is judged that the correction may be difficult or not possible, the recording on the recording medium 47 is stopped (Step S32).

In the second embodiment, because the edge position of the recording medium 47 can be sensed in a simple manner during the image recording, should the recording medium 47 cause a skew during the image recording, such a skew is detected in a reliable manner. Because the movement of the scanning carriage 42 and the ejection of ink drops from the recording head 43 are controlled according to the amount of skew thus detected, satisfactory image recording can be achieved.

Figure 13:
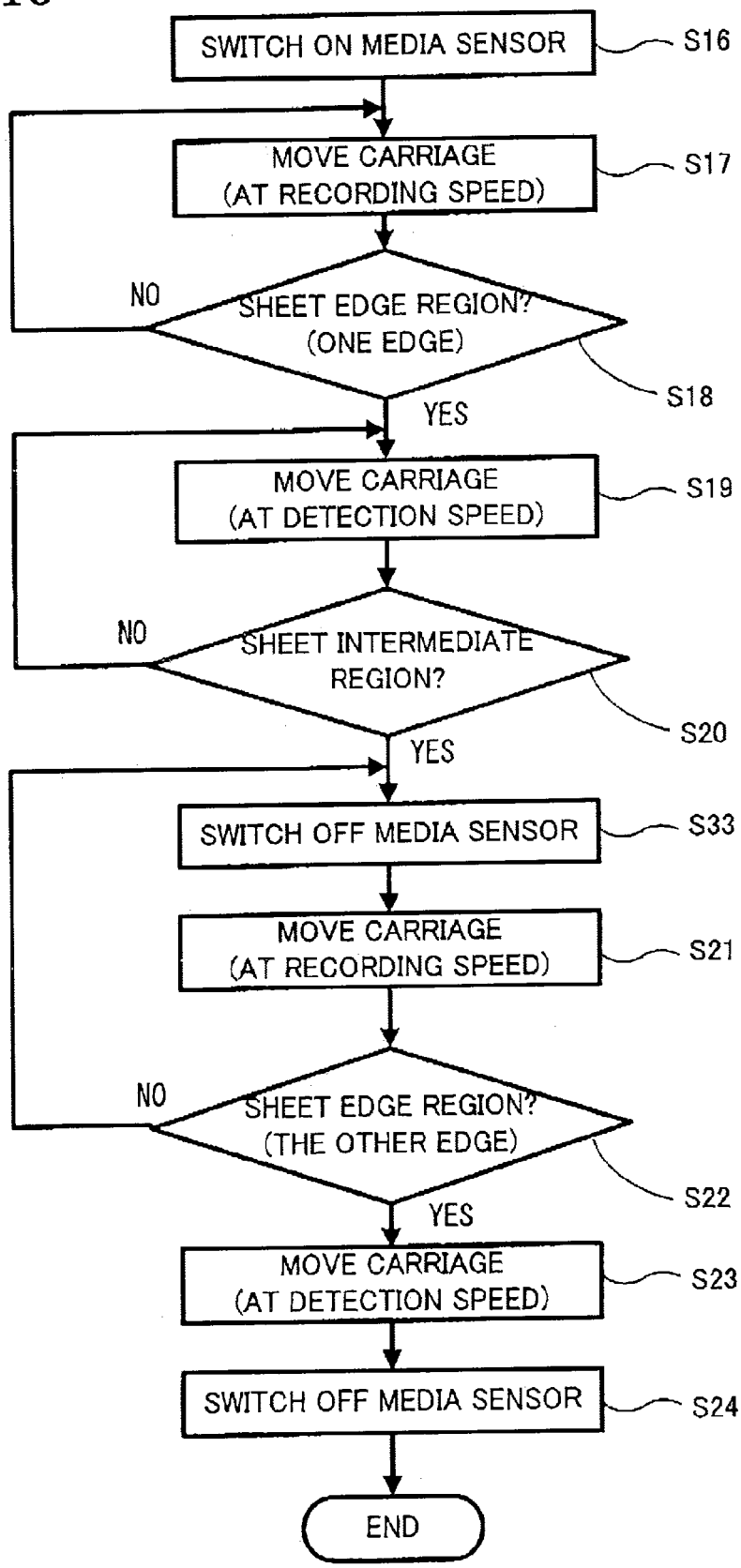
FIG. 13 is a flowchart of a portion of the recording procedure according to a modification of each embodiment of the present invention.

FIG. 13 is a flowchart of a sensing procedure in the intermediate detection region according to a modification of each of the first embodiment and the second embodiment.

As is shown in FIG. 10, in the first and second embodiments, the media sensor 115 stays ON during the sensing in the intermediate detection region even when the media sensor 115 is present in the sheet intermediate region. In other words, the edge position is sensed even when the media sensor 115 is moved at a high speed (recording speed). However, the edge position information thus detected is less relevant in the sheet intermediate region. Therefore, in the sensing in the intermediate detection region, as is shown in FIG. 13, the media sensor 115 may be deactivated when the media sensor 115 is present in the sheet intermediate region (Step S33).

In this modification, because the sensing is not performed in the sheet intermediate region, the scanning carriage 42 may be moved at a high speed in this region. The sensing time for the edge position of the recording medium 47 in the intermediate detection region may therefore be shortened. In addition, because the control device 69 does not have to store and process the AD value outputted from the media sensor 115 for the sheet intermediate region, there is an advantage that an available capacity of the RAM may be increased.

While the invention has been described in connection with embodiments, it will be understood by those skilled in the art that other variations and modifications of the embodiments described above may be made without departing from the scope of the invention. Other embodiments will be apparent to those skilled in the art from a consideration of the specification or practice of the invention disclosed herein. It is intended that the specification and the described examples are considered merely as exemplary of the invention, with the true scope of the invention being indicated by the following claims.

What is claimed is:

1. An image recording apparatus comprising:

a conveying mechanism for conveying a recording medium in a conveying direction;

a scanning carriage comprising a recording head and a detector, the recording head recording an image on the recording medium; the detector comprising a signal source for transmitting a detection signal to a surface of the recording medium and a signal receiving device for receiving a reflected signal from the recording medium to detect a first edge and a second edge of the recording medium in a leading edge detection region and in an intermediate detection region located between the leading edge detection region and the trailing edge of the recording medium; and the scanning carriage moves in a scanning direction orthogonal to the conveying direction;

a storing unit for storing a first position of the first edge of the recording medium in the scanning direction and a second position of the second edge of the recording medium in the scanning direction, which are detected by the detector; and a controller for controlling movement of the scanning carriage, the controller controlling a moving speed of the scanning carriage, such that the detector detects across the recording medium in the scanning direction including the first edge in the scanning direction and the second edge in the scanning direction in the leading edge detection region and in the intermediate detection region, wherein the controller maintains the moving speed of the scanning carriage at a first speed from the first edge in the scanning direction to the second edge in the scanning direction when the detector detects the first edge in the scanning direction and the second edge in the scanning direction in the leading edge detection region, and the controller, when the detector detects the first edge in the scanning direction and the second edge in the scanning direction in the intermediate detection region, controls the moving speed of the scanning carriage at the first speed in two side edge regions including the first edge in the scanning direction and the second edge in the scanning direction and at a second speed greater than the first speed in a region between the two side edge regions.

2. The image recording apparatus according to claim 1, wherein the controller deactivates the detector while the scanning carriage passes over a sheet intermediate region, the sheet intermediate region comprising at least a portion of the intermediate detection region, but excluding the two side regions.

3. The image recording apparatus according to claim 1, wherein the controller activates the detector, so that the first edge in the scanning direction and the second edge in the scanning direction are detected while the recording head is operating.

4. The image recording apparatus according claim 1, wherein the signal source is a light source.

5. The image recording apparatus according to claim 1, wherein the signal Source is an electromagnetic energy source.

6. The image recording apparatus according to claim 1, wherein the sensor is disposed on a upstream edge of the recording head with respect to the conveying direction.

7. The image recording apparatus according to claim 1, wherein the controller determines an amount of skew of the recording medium.

8. The image recording apparatus according to claim 7, wherein the controller corrects a image recording timing according to the amount of skew of the recording medium.

9. The image recording apparatus according to claim 7, wherein the controller stops image recording according to the amount of skew of the recording medium.

* * * * *